US012006080B2

(12) United States Patent
Otxoa-Aizpurua Calvo et al.

(10) Patent No.: US 12,006,080 B2
(45) Date of Patent: Jun. 11, 2024

(54) VERTICAL PACKAGING MACHINE

(71) Applicant: ULMA Packaging, S. Coop., Oñati (ES)

(72) Inventors: Alberto Otxoa-Aizpurua Calvo, Oñati (ES); Oier Olalde Arregui, Oñati (ES); Eneko Izquierdo Ereño, Oñati (ES)

(73) Assignee: ULMA PACKAGING, S. COOP., Oñati (ES)

( * ) Notice: Subject to any disclaimer, the term of this patent is extended or adjusted under 35 U.S.C. 154(b) by 196 days.

(21) Appl. No.: 17/837,557

(22) Filed: Jun. 10, 2022

(65) Prior Publication Data

US 2022/0306328 A1 Sep. 29, 2022

Related U.S. Application Data

(63) Continuation of application No. PCT/ES2020/070807, filed on Dec. 18, 2020.

(30) Foreign Application Priority Data

Dec. 20, 2019 (EP) ..... 19383158

(51) Int. Cl.
*B65B 37/02* (2006.01)
*B65B 9/20* (2012.01)
*B65B 37/14* (2006.01)

(52) U.S. Cl.
CPC ..... *B65B 37/02* (2013.01); *B65B 9/20* (2013.01); *B65B 37/14* (2013.01)

(58) Field of Classification Search
CPC ..... B65B 37/00; B65B 37/14; B65B 9/20
See application file for complete search history.

(56) References Cited

U.S. PATENT DOCUMENTS

| | | | | |
|---|---|---|---|---|
| 4,738,287 | A | 4/1988 | Klinkel | |
| 6,116,001 | A | 9/2000 | Roman et al. | |
| 6,179,015 | B1 * | 1/2001 | Kammler | B65B 9/20 141/94 |
| 11,344,037 | B2 * | 5/2022 | Otxoa-Aizpurua Calvo | B65B 31/045 |

FOREIGN PATENT DOCUMENTS

| | | | |
|---|---|---|---|
| DE | 8813375 | U1 | 12/1988 |
| EP | 2489596 | A2 | 8/2012 |
| EP | 3530575 | A1 | 8/2019 |
| JP | 2002347705 | A | 12/2002 |
| WO | 2007108479 | A1 | 9/2007 |

OTHER PUBLICATIONS

International Search Report, PCT/ES02020/070807, Feb. 12, 2021, 11 pages.

* cited by examiner

*Primary Examiner* — Timothy L Maust
(74) *Attorney, Agent, or Firm* — Edell, Shapiro & Finnan, LLC

(57) ABSTRACT

A vertical packaging machine that includes a hopper with a hopper inlet mouth and at least one hopper outlet mouth, a tube arranged downstream of the hopper with a tube inlet mouth and a tube outlet mouth. A supply conduit is formed by at least the hopper and the tube. Acceleration means is provided and configured for injecting a gaseous fluid into the supply conduit through two injection ports arranged in the supply conduit at different heights with respect to the tube outlet mouth and for causing, with said injection, part of the air present in said supply conduit above the corresponding injection port to follow the injected flow.

20 Claims, 6 Drawing Sheets

VERTICAL PACKAGING MACHINE

CROSS-REFERENCE TO RELATED APPLICATIONS

This application relates to and claims the benefit and priority to International Application No. PCT/ES2020/070807, filed Dec. 18, 2020, which claims the benefit and priority to European Application No. EP19383158.3, filed Dec. 20, 2019.

TECHNICAL FIELD

The present invention relates to packaging machines, and particularly to vertical packaging machines.

BACKGROUND

Some types of conventional packaging machines, particularly vertical packaging machines, comprise a feeder with which there is supplied a continuous film which is wound in the form of a reel. The film is supplied to a vertical forming element, imparting a tubular shape to said film. The machine also comprises a drive device for driving the tubular-shaped film in a downward forward movement direction, about the forming element, and at least one longitudinal sealing tube sealing the longitudinal ends of the tubular-shaped film together, a film tube thus being generated. The forming element is open at its upper part and at its lower part.

A machine of this type further comprises a transverse sealing and cutting tube, arranged downstream of the forming element, for generating a transverse seal and a transverse cut in the film tube. After this operation (or operations), a tube closed at one end upstream of the transverse cut, and a package closed at both ends downstream of the transverse cut and physically separated from the film tube is obtained. During said operation (or operations), the most upstream end of the package is closed and corresponds with the end of the film tube from the previous cycle that has been closed, i.e., the transverse seal closing one end of the tube of the film tube will be a closed end of the package obtained in the following cycle.

The machine also comprises a hopper or similar device upstream of the forming element, from where the product to be packaged is introduced into the forming element, the product being arranged on the transverse seal of the film tube closed at one end after falling through the forming element. The product is introduced into the forming element by its upper part, and the lower part thereof exits towards the transverse seal of the film tube. It must be taken into consideration that the film tube surrounds the forming element, such that when the product is introduced into the forming element, it is also introduced into the film tube.

The product is supplied in a controlled manner from the hopper (or from upstream of the hopper), a predetermined amount being supplied each time (if it is of the type for lettuce, snacks, or the like) or the unit product itself, which corresponds with the amount of product to be packaged in each package.

US6179015B1 and EP3530575A1 disclose a machine comprising a forming element and a hopper arranged upstream of the forming element and aligned with said forming element, at least said forming element and said hopper forming a supply conduit through which the product to be supplied falls. The machine further comprises a flow generator with an injection device configured for injecting a gaseous fluid and a distributor for directing said fluid to the supply conduit, and a control device configured for controlling the injection of fluid.

In the machine disclosed in US679015B1, the distributor comprises an inlet mouth for receiving the injected flow through the injection device and an annular outlet mouth arranged in height between a lower opening of the hopper and an upper opening of the forming element, for introducing said fluid in the supply conduit. The machine further comprises a sensor arranged below the hopper and the annular outlet mouth for detecting the presence of the product to be packaged, and the control device is configured for controlling the injection of fluid based on said detection, such that the injected flow accelerates the product in the downward direction towards the forming element. In this machine, when the fluid is injected once all of the product has gone from the height of the annular outlet mouth, it is impossible to prevent the product upstream of said outlet mouth from jamming. This jamming would occur upstream of the sensor, such that the product could not reach the height of said sensor, and therefore the injection of the fluid would not be generated either.

In the machine disclosed in EP3530575A1, the control device is configured for causing the injection device to perform an injection of fluid of a given duration for each product to be packaged in one and the same package, and for said injection device to perform each injection of fluid such that said injected flow begins to reach the upper opening of the forming element before all of the product to be packaged in one and the same package has passed completely at the height of the outlet mouth, and ends up reaching the upper opening of the forming element once all of the product has gone through said upper opening. This therefore hinders the product from being able to become jammed upstream of said upper opening.

SUMMARY

Disclosed is a vertical packaging machine. The machine is configured for packaging products, particularly for packaging vegetable products such as leaves of spinach, lettuce, parsley, or other such products, for example, the characteristics of which (with a unit weight and large surface) cause a slow gravity-induced falling speed and a high risk of jamming in regions where the area of passage for the product is reduced. The machine comprises a hopper with a hopper inlet mouth through which the products to be packaged are introduced and with at least one hopper outlet mouth downstream of the hopper inlet mouth, a vertical tube arranged downstream of the hopper and comprising a tube inlet mouth and a tube outlet mouth downstream of the tube inlet mouth, a supply conduit through which the product to be packaged falls, which is formed by at least the hopper, the tube and an intermediate region extending between the hopper outlet mouth and the tube inlet mouth, and acceleration means configured for accelerating the falling of the product through the supply conduit.

The hopper outlet mouth delimits a stepped outlet area or an outlet area in a non-horizontal plane, such that said outlet area comprises regions at different heights with respect to the tube outlet mouth. The acceleration means is configured for injecting a gaseous fluid into the supply conduit, in a downward direction, through at least one first injection port arranged in the intermediate region of the supply conduit at a first vertical height with respect to the tube outlet mouth, and a second injection port arranged in the intermediate region of the supply conduit at a second vertical height with respect to the tube outlet mouth different from the first vertical height, and for causing, with said injection, pressure drop to be generated upstream of the injection ports and, accordingly, at least part of the air present in said supply conduit above the corresponding injection port to follow the injected flow (due to the Venturi effect). The first injection port is horizontally facing the interior of the hopper and the second injection port is not horizontally facing said interior of the hopper.

Therefore, an injection of gaseous fluid upstream of the inlet mouth of the tube can be performed with the machine of the invention, said injection being able to cause at least part of the air present in the supply conduit above the corresponding injection port to follow the injected flow and increase the falling speed thereof, due to the effect known as the Venturi effect, with an airstream being produced which pushes the product from the hopper into the tube, such that the product reaches the inlet mouth of the tube having been accelerated while traveling towards the same, which facilitates the passage thereof through said inlet mouth and prevents, to a greater extent, said product from jamming at the outlet mouth of the hopper and/or in the inlet mouth of the tube. Furthermore, having injection ports at different heights and arranged as indicated in the intermediate region of the supply conduit causes not all the product to be accelerated by said injection of gaseous fluid in the same manner (or at the same time), said product reaching said inlet mouth in an "elongated" shape, i.e., part of the product arrives before another part of said product, going through the outlet mouth of the hopper and the tube inlet mouth in a progressive manner, which even further facilitates the passage thereof into the tube and prevents, to a greater extent, the possibility of said project jamming.

Since the product reaches the tube inlet mouth in an "elongated" shape, it also allows the diameter of said tube to be decreased, and since the tube has a smaller diameter in this case, the amount of film used for each package is reduced as a smaller amount of film is required to surround said tube.

These and other advantages and features will become apparent in view of the figures and the detailed description.

DETAILED DESCRIPTION

Figure 1:
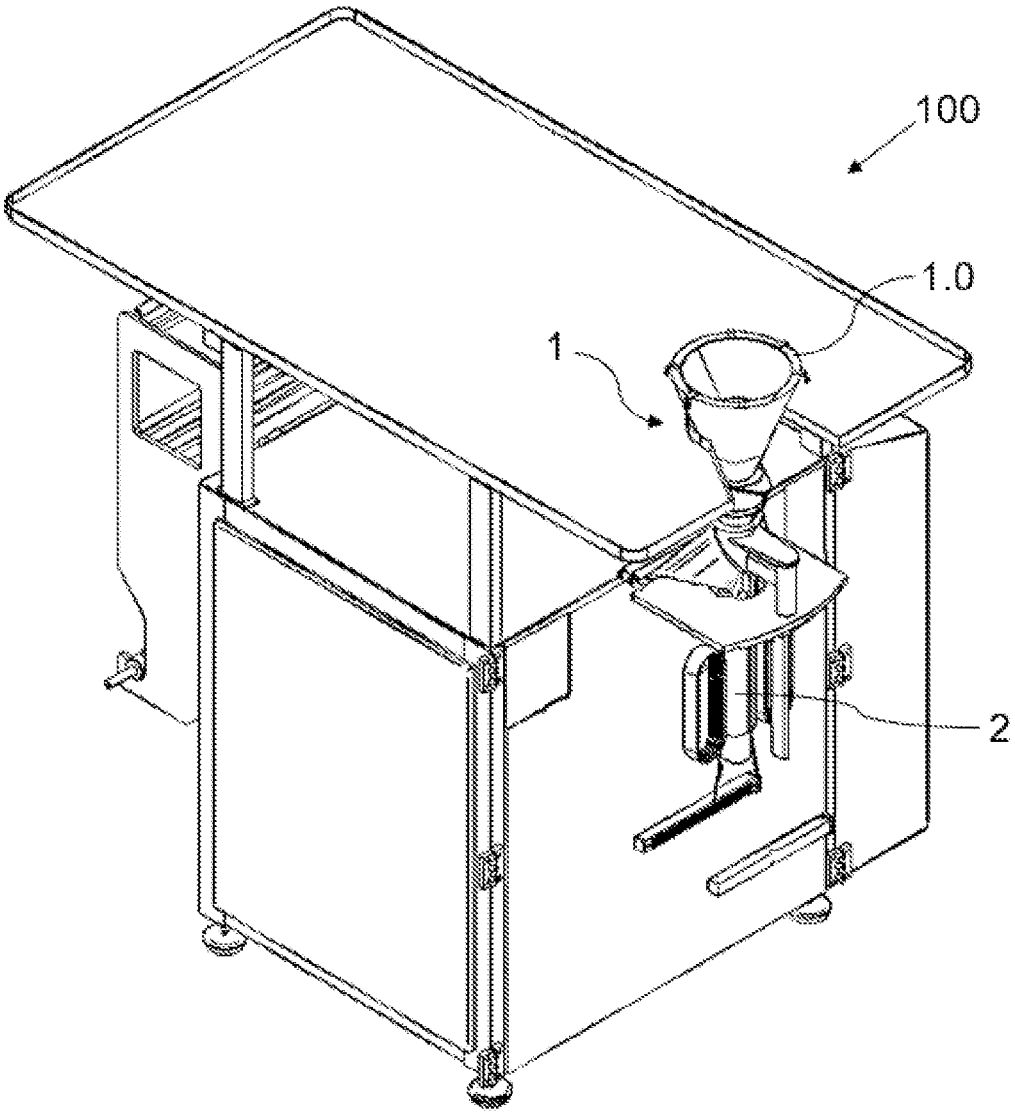
FIG. 1 shows a vertical packaging machine according to a first embodiment.

The vertical packaging machine 100 of the invention, in any of its embodiments, comprises at least:

a hopper 1 with a hopper inlet mouth 1.0 through which the products to be packaged are introduced and with at least one hopper outlet mouth 1.01 downstream of the hopper inlet mouth 1.0;

a vertical tube 2 arranged downstream of the hopper 1 and comprising a tube inlet mouth 2.0 and a tube outlet mouth 2.1 downstream of the tube inlet mouth 2.0;

a supply conduit 200 through which the product to be packaged falls, which is formed by at least the hopper 1, the tube 2 and an intermediate region 201 extending between the hopper outlet mouth 1.01 and the tube inlet mouth 2.0, and acceleration means configured for accelerating the falling of the product through the supply conduit 200.

The tube inlet mouth 2.0 is communicated with said hopper 1, such that the products to be packaged introduced in the hopper 1 reach the interior of the tube 2 through said tube inlet, mouth 2.0.

The hopper outlet mouth 1.01 delimits an outlet area which is stepped or which is arranged on a non-horizontal plane, such that said outlet area comprises regions at different heights with respect to the tube outlet mouth 2.1. The acceleration means is configured for injecting a gaseous fluid into the supply conduit 200, in a downward direction, through at least one first injection port 9.1 arranged in the intermediate region 201 of the supply conduit 200, at a first vertical height with respect to the tube outlet mouth 2.1, and as second injection port 9.2 arranged in the intermediate region 201 of the supply conduit 200, at a second vertical height with respect to the tube outlet mouth 2.1 different from the first vertical height, and for causing, with said injection, at least part of the air present in said supply conduit 200 above the corresponding injection port 9.1 and 9.2 to follow the injected flow (effect known as the Venturi effect), driving the corresponding part of the product with it and increasing its falling speed. The first injection port 9.1 is horizontally facing the interior of the hopper 1 and the second injection port 9.2 is not horizontally facing said interior of the hopper 1. A stepped outlet area or an outlet area arranged in a non-horizontal plane causes different parts of the product to be packaged from reaching and going through the outlet area delimited by the hopper outlet mouth 1.01 at different times, such that the product goes through the outlet mouth of the hopper 1.01 in a progressive manner, causing the shape of the product to be elongated downstream of said outlet area. Furthermore, as a result of having injection ports 9.1 and 9.2 at different of heights, the effect generated by the injected flow (the airstream causing the injected flow upstream of the injection ports 9.1 and 9.2) acts at different heights of the supply conduit and even further elongates the shape of said product, which in addition to preventing jamming to a greater extent (since the airstream pushes the product from the hopper 1 into the tube 2), also increases the packaging speed, and therefore the productivity of the machine 100.

Preferably, the acceleration means is configured for directing the gaseous fluid into the supply conduit 200, in a downward direction with an inclination of between 0° and 45° with respect to the vertical. Said airstream thereby tends to follow the contour of an inner surface of the supply conduit 200: it tends to be drawn by the inner surface of the supply conduit 200, according to the effect known as the Coanda effect. This prevents the injected flow from generating turbulences which may negatively affect the falling of the product through the supply conduit 200, while at the same time allows the air located above the injection ports 9.1 and 9.2 to be suctioned in a more effective and directed manner.

Preferably, the acceleration means comprises at least one flow generator 101 with at least one injection device configured for injecting the gaseous fluid into the supply conduit 200, in the intermediate region 201 of the supply conduit 200 and through the injection ports 9.1 and 9.2, the arrangement and actuation of said injection device being configured for generating a pressure drop upstream of the injection ports 9.1 and 9.2 when it injects a gaseous fluid due to the Venturi effect.

The hopper 1 could be formed by a single element, or it could be formed by a plurality of hollow elements arranged on top of one another, each hollow element comprising its corresponding central axis Y1.0 or Y1. The central axes Y1.0 and Y1 may or may not coincide, they may all be vertical, or each one can have a given angle with respect to the vertical (where one of said angles may be equal to zero). In the context of the invention, hopper 1 is a hollow element, or assembly of hollow elements, arranged upstream of the intermediate region 201, at least the most downstream hollow element comprising an inner area the size of which decreases in the downward direction. The hollow elements the inner area of which decreases in the downward direction are preferably cone-shaped, and the rest (if there are any) are preferably cylindrical. In the context of the invention, when it is indicated that the hopper 1 has a hopper axis Y1, the central axis of the most downstream hollow element (the hollow element closest to the tube 2) must be considered.

FIGS. 1 to 4 show a first embodiment of the vertical packaging machine 100 of the invention. The hopper 1 comprises a longitudinal hopper axis Y1 (which is central and vertical buy may not be, depending on the configuration of the hopper 1) and two hopper outlet mouths 1.01 and 1.02 at different heights, between which a stepped outlet area is delimited, the first injection port 9.1 being associated with a first hopper outlet mouth 1.01 and the second injection port 9.2 being associated with a second hopper outlet mouth 1.02.

Figure 2:
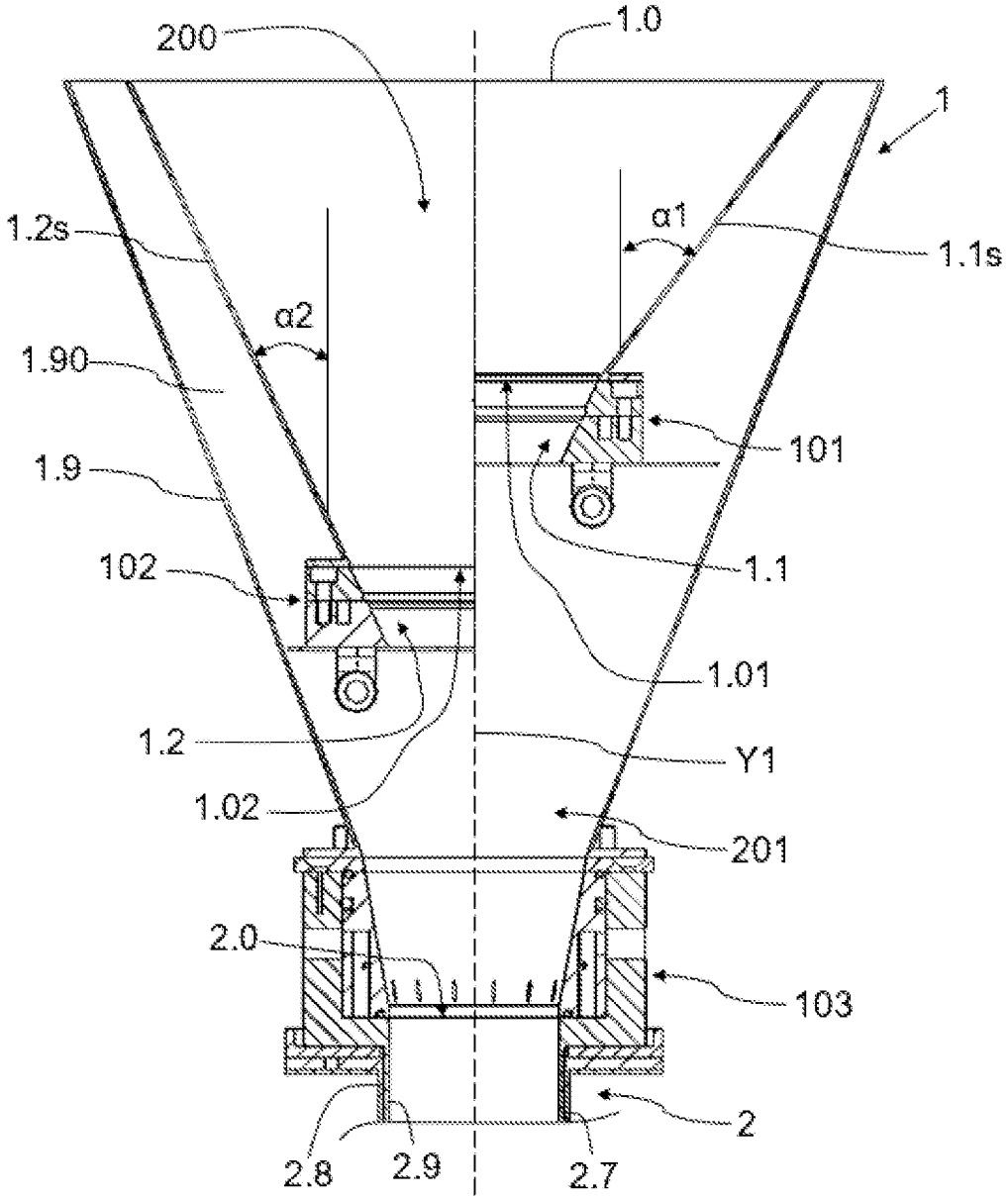
FIG. 2 shows a cross-section of some elements of the machine of FIG. 1 to partially show a supply conduit of said machine.
Figure 3:
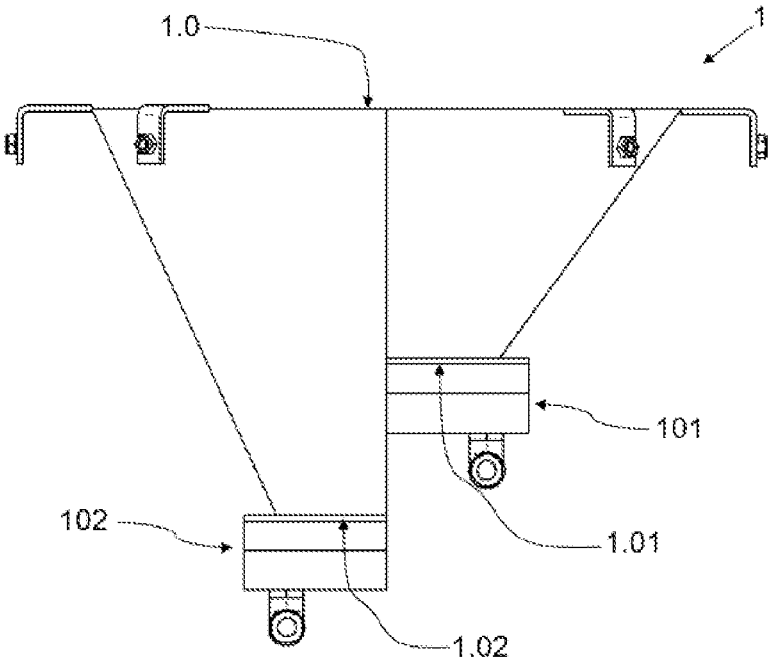
FIG. 3 shows a side view of the hopper of the machine of FIG. 1.
Figure 4:
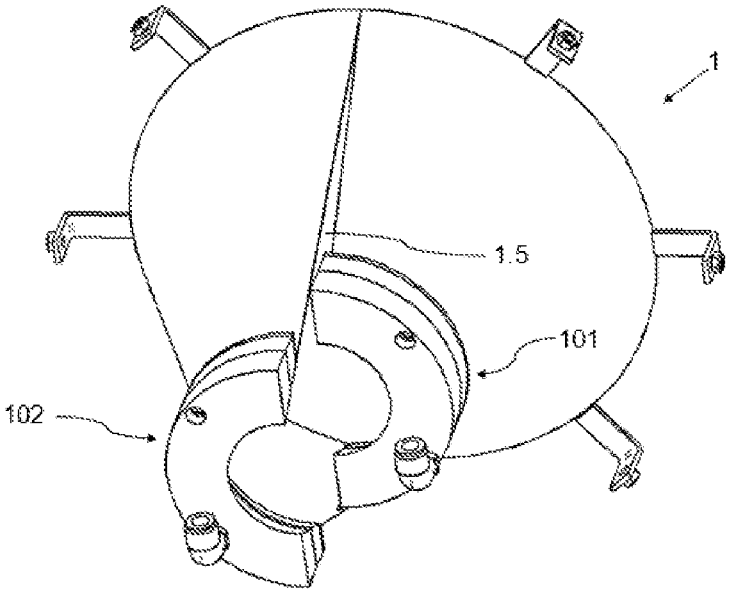
FIG. 4 shows a perspective view of the hopper of the machine of FIG. 1.

In the first embodiment, the hopper 1 is formed by a single hollow element, shown in FIGS. 3 and 4, with a hopper axis Y1 coinciding with a longitudinal tube axis Y2 of the tube 2, said hopper axis Y1, therefore, also being tube axis Y2 of the tube 2 and the axis of the supply conduit 200, as seen in FIG. 2.

The tube 2 can be a coaxial tube comprising an inner tube 2.9, the inner tube 2.9 comprising the inlet mouth 2.0 receiving the products coming from the hopper 1. In the case of a coaxial tube, the coaxial tube further comprises an outer tube 2.8 having a larger diameter than the inner tube 2.9, and between both tubes 2.8 and 2.9 an open space 2.7 is generated, communicating the most upstream part with the most downstream part.

In the first embodiment, the machine 100 comprises a flow generator 101 associated with the hopper 1 and comprised in the acceleration means, said flow generator 101 comprising an injection device configured for injecting a gaseous fluid into the supply conduit 200 in an injection region 1.1 facing the interior of said hopper 1, in a downward direction towards the tube inlet mouth 2.0 of the tube 2 (into the inner tube 2.9 of the coaxial tube, in the event that the tube 2 is a coaxial tube). The injection region 1.1 comprises an angular length about the hopper axis Y1 less than 360°. With an angular length less than 360°, it must be interpreted that the gaseous fluid entering the interior of the supply conduit 200 does not affect the entire inner perimeter of the supply conduit 200 the same way, so said injection and the airstream generated due to the Venturi effect does not affect the entire perimeter of the product the same way. Therefore, the injection device does not inject gaseous fluid into part of said angular length. Preferably, said angular length is less than or equal to 180°, although it is also possible to use other angular lengths provided that they are less than 360°. The supply conduit 200 preferably comprises a plurality of injection ports distributed homogeneously about the hopper axis Y1 and facing the injection region 1.1, including among the first injection port 9.1. Preferably said injection ports are all at the same height with respect to the tube outlet mouth 2.1.

When the product is introduced into the hopper 1, said product generally falls through the entire diameter of said hopper 1. As a result of this injection region 1.1 and its angular length (which does not cover 360°), the effect generated by the injection of gaseous fluid through the injection device (the airstream generated upstream of the injection region 1.1) does not affect the entire inner perimeter of the hopper 1 to the same extent; it mainly affects the part which is above said injection region 1.1, and in the part of the perimeter that is least affected or not affected by said injection (the part of the angular length about the hopper axis Y1 arranged above the angular length not covered by the injection region 1.1), the product falling through said part accelerates to a lesser extent (or does not accelerate). Therefore, the product accelerates in a non-homogeneous manner, and the effect of elongating said product inside the supply conduit, as described above in detail, is obtained given that the part that is not affect (or affected to a lesser extent) by said airstream is delayed with respect to the other part (generally, the less the airstream affects a part of the product, the more delayed said part of the product will be).

When a product is packaged as described above, a film tube surrounds the tube 2 and said film tube has a transverse end below the tube 2 that is closed. If the tube 2 is a coaxial tube such as the one described above, the gaseous fluid that is injected into the hopper 1 as well as the generated airstream which reaches the interior of the tube 2 (the interior of the inner tube 2.9 in this case) can be discharged from the tube 2 through the space 2.7, after exiting at the lower part of the interior of said inner tube 2.9, thereby being prevented from remaining in the generated final package or from exiting in the opposite direction with respect to the falling of the product through the interior of said inner tube 2.9.

In the embodiment in FIGS. 1 to 4, the machine 100 comprises a further flow generator 102 associated with the hopper 1, comprising a further injection device configured for injecting a gaseous fluid into the supply conduit 200 in a further injection region 1.2 of said supply conduit 200, in a downward direction towards the tube inlet mouth 2.0 of the tube 2. The further injection region 1.2 is arranged downstream of the injection region 1.1, as shown in FIG. 2, the further flow generator 102 therefore being arranged downstream of the flow generator 101, as shown in FIGS. 2 and 3. The arrangement of the hopper outlet mouths 1.01 and 1.02 delimit a stepped outlet area which allows said product, or part of the product, to be even further drawn and accelerated before reaching the tube inlet mouth 2.0 and allows the product to be introduced progressively into the tube 2.0, preventing the risk of jamming. Since the product reaches the height of the further injection region 1.2 in an elongated state (due to the effect of the injection performed in the injection region 1.1 described above, since said injection region 1.1 is upstream of said further injection region 1.2), said further injection region 1.2 draws and accelerates even more the falling of the product through the supply conduit 200 without at all increasing the risk of jamming being generated in said tube inlet mouth 2.0, which allows the speed of the packaging cycle of the machine 100 to be increased and the diameter of the tube, and as a result the amount of film needed for generating a package to be reduced. The supply conduit 200 preferably comprises a second assembly of ports formed by a plurality of injection ports including the second injection port associated with the second hopper outlet mouth 1.02.

In the first embodiment shown in FIGS. 1 to 4, the machine 100 comprises two flow generators 101 and 102, but alternatively, the machine 100 may comprise more flow generators as explained below.

The further injection region 1.2 preferably comprises at least one part that does not angularly coincide with the injection region 1.1 about the hopper axis Y1, and preferably none of the injection ports of the second injection assembly vertically coincides with any port of the first injection assembly. This ensures to a greater extent the acceleration of at least part of the product that has not previously been accelerated, or which has been to a lesser extent, due to the effect of the injection performed in the injection region 1.1, which assures a drawing and an acceleration in the fall through the supply conduit 200 of all the product to be packaged. If there is a further injection region 1.2 with at least one part that angularly coincides with the injection region 1.1, the product not becoming jammed in the tube inlet mouth 2.0 could be even further ensured, since the part of the product previously accelerated by the injection region 1.1 is even further accelerated when it reaches the further injection region 1.2 angularly coinciding with the injection region 1.1, while at the same time the part of the product accelerated to a lesser extent (or not previously accelerated) by the injection region 1.1 is also drawn and accelerated when it next reaches the part of said further injection region 1.2 which does not angularly coincide with the injection region 1.1.

In some embodiments, like in the case of the first embodiment, the further injection region 1.2 does not angularly coincide with the injection region 1.1 about the hopper axis Y1 of the hopper 1, as shown in FIG. 4, such that none of the injection ports of the second injection assembly vertically coincides with any port of the first injection assembly. Therefore, in the second injection region 1.2 only the part of the product that has not previously been accelerated, or which has been accelerated to a lesser extent, is accelerated due to the effect of the injection performed in the injection region 1.1, and a smaller amount of gaseous fluid and airstream is introduced into the supply conduit 200 for accelerating the falling of the product. Generally, the introduction of gaseous fluid generating an airstream due to the Venturi effect allows the falling of the product to be accelerated, but it has the drawback of having to later discharge said gaseous fluid and said air, which cannot be included in the final package. Being able to discharge gaseous fluid and air may therefore involve increases in the diameter of the tube 2, for example (in the case of a coaxial tube, to offer a larger space 2.7). This is why in the first embodiment the further injection region 1.2 does not angularly coincide with the injection region 1.1 about the hopper axis Y1.

Preferably, in said embodiments the second injection region 1.2 furthermore covers at least the angular length not covered by the injection region 1.1, such that as a result the gaseous injected fluid affects the 360° of the interior of the perimeter of the supply conduit 200 (adding both injections together) and the entire perimeter of the product that is introduced into said hopper 1 is accelerated. The largest possible part of the product is thereby accelerated with the small possible amount of gaseous fluid.

Preferably, as occurs in the first embodiment, the angular length of the further injection region 1.2 covers the entire perimeter (360°), such that the advantage of accelerating all the product towards the inlet mouth 2.0 of the inner tube 2.9 of the coaxial tube 2 is obtained, while at the same time the product is kept elongated.

In other embodiments not depicted in the figures, the machine 100 comprises a plurality of further flow generators (as many as may be required), each of them comprising a respective further injection device configured for injecting a gaseous fluid into the supply conduit 200 in a respective further injection region of said supply conduit 200, which preferably corresponds with a region of the inner perimeter of said supply conduit 200, in a downward direction towards the tube inlet mouth 2.0 of the tube 2. Each further injection region can be at a different height with respect to said inlet mouth 2.0 in the direction of the hopper axis Y1 (or with respect to the inlet mouth 1.0 of the hopper 1 in said direction) and at a different height with respect to the height at which injection regions 1.1 and 1.2 are located, allows a progressive entry of the product and different accelerations of the product being generated along its fall, and each further injection region comprises a respective angular length about the hopper axis Y1. The arrangement and angular length of the further injection regions can be selected as may be required, based on how the product (or part of it) is to be accelerated, it comprises at least three hopper outlet mouths at different heights between which a stepped outlet area is delimited, each hopper outlet mouth comprising at least one injection port, and the acceleration means being configured for generating a pressure drop upstream of each of the hopper outlet mouths due to the injection of gaseous fluid into the supply conduit 200 through the corresponding injection port, said acceleration means comprising a flow generator associated with each hopper outlet mouth, and each flow generator comprising an injection device configured for injecting a gaseous fluid in a further injection region of the interior of the supply conduit 200 in a downward direction and through the corresponding injection port.

Preferably, each flow generator 101 and 102 is associated with a respective angular segment 1.1*s* and 1.2*s* of the hopper 1, such that the machine 100 comprises as many angular segments 1.1*s* and 1.2*s* as flow generators 101 and 102 associated with the hopper 1 and configured for injecting a gaseous fluid into the supply conduit 200. Each angular segment 1.1*s* and 1.2*s* comprises a given angular length about the hopper axis Y1 of the hopper 1 and a given axial length in the direction of the hopper axis Y1 of the hopper 1, from the inlet mouth 1.0 of said hopper 1. Each angular segment 1.1*s* and 1.2*s* comprises a corresponding outlet mouth communicated with the inlet mouth 2.0 of the tube 2, such that each angular segment 1.1*s* and 1.2*s* extends in the direction of the hopper axis Y1 between the hopper inlet mouth 1.0 and the outlet mouth of the corresponding angular segment 1.1*s* and 1.2*s* (said extension is the axial length) and is communicated with the interior of the tube 2. The given axial lengths of all the angular segments 1.1*s* and 1.2*s* can be different from one another, the different outlet mouths thus being arranged at different heights with respect to the tube inlet mouth 2.0, and the injection region 1.1 and the further injection region(s) 1.2 is/are preferably at the height of the outlet mouth of the corresponding angular segment 1.1*s* and 1.2*s*. Said outlet mouths correspond with the hopper outlet mouths 101 and 1.02 and form a stepped outlet area formed by a first semi-area on a horizontal plane at the height of the first hopper outlet mouth 1.01 and a second semi-area on a horizontal plane at the height of the second hopper outlet mouth 1.02.

Preferably, the hopper 1 may comprise a wall 1.5 between every two angular segments 1.1*s* and 1.2*s*, as shown in FIG. 4, to prevent the product or part of it from getting out of the hopper 1 between the different angular segments 1.1*s* and 1.2*s*.

Preferably, the outlet mouths of the angular segments 1.1*s* and 1.2*s* comprise a semicircular shape, in the event that the corresponding injection region does not cover the entire corresponding inner perimeter of the hopper 1, or a circular shape, in the event that the corresponding injection region covers the corresponding entire inner perimeter of the hopper 1. In both cases the radius is preferably equal to the radius of the tube 2 (or of the inner tube 2.9 when the tube 2 corresponds with a coaxial tube). Furthermore, said outlet mouths are preferably concentric to one another and concentric to the tube 2. This allows the products to more easily enter said tube 2.

Each cross-section of the different angular segments 1.1*s* and 1.2*s* of the hopper 1 furthermore defines a given angle $\alpha 1$ and $\alpha 2$ with respect to the hopper axis Y1 of said hopper 1, said angle $\alpha 1$ and $\alpha 2$ preferably being different from one angular segment 1.1*s* and 1.2*s* to another. This allows the falling of the product to the corresponding injection region 1.1 and 1.2 to be controlled. For example, the smaller the given angle $\alpha 1$ and $\alpha 2$, the less it will take the product to arrive from the hopper inlet mouth 1.0 to the corresponding injection region 1.1 and 1.2. The axial lengths and the given angles $\alpha 1$ and $\alpha 2$ of each of the angular segments 1.1*s* and 1.2*s* can thus be related as may be required in order to achieve the result required in each case. Preferably, the angle $\alpha 1$ and $\alpha 2$ of a cross-section of an angular segment 1.1*s* and 1.2*s* is smaller the greater the axial length of the corresponding angular segment 1.1*s* and 1.2*s*.

The machine 100 preferably comprises an outer casing 1.9 at least partially externally surrounding the angular segments 1.1*s* and 1.2*s* of said hopper 1 and preferably at least the injection regions 1.1 and 1.2. Said casing 109 extends at least from the height of the injection region 1.1 and 1.2 arranged most upstream until covering the injection regions 1.1 and 1.2. Between the casing 109 and the angular segments 1.1*s* and 1.2*s* of the hopper 1 there is defined a space 1.90, which is open preferably towards the exterior, at least in its most upstream part, so at least part of the gaseous fluid which is injected into the supply conduit 200 (with the flow generator 101 and the further flow generators 102, as the case may be) and at least part of the airstream generated due to the effect of the injection of said gaseous fluid can be discharged.

Therefore, since part of the fluid and of the airstream is discharged through said space 1.90, a larger amount of gaseous fluid can be injected into the hopper 1 without needing to increase the space 2.7 between the tubes 2.8 and 2.9 of the tube 2, which allows the amount of film used not being increased (if the space 2.7 is increased due to an increase in the diameter of the outer tube 2.8, the film tube surrounding it is larger and therefore requires more film); or the diameter of the tube 2 can even be reduced, with the amount of film required for each package being reduced.

Furthermore, as a result of non-homogeneous accelerations of the product, which entails an elongated shape of the product as described, the tube 2 (the inner tube 2.9 in the case of a coaxial tube) may comprise a smaller diameter and either the space 2.7 can be increased if the diameter of the outer tube 2.8 is maintained (offering a better path for the gaseous fluid discharge), or else both diameters (or the diameter of the tube 2, if it is not a coaxial tube) can be reduced proportionally, maintaining the same space 2.7, in which case the amount of film needed is reduced.

The machine 100 may comprise a further flow generator 103 in the intermediate region 201 of the supply conduit 200, comprising an injection device configured for injecting a gaseous fluid into said intermediate region 201, in a downward direction towards the tube inlet mouth 2.0 of said tube 2 (of the inner tube 2.9 of the coaxial tube, where appropriate), which helps to even further accelerate the packaging process, since the passage of the product through the tube 2 is accelerated. This gaseous fluid can furthermore be discharged through the space between the two tubes 2.8 and 2.9 of the coaxial tube, as described above, when the tube 2 is a coaxial tube. The flow generator 103 is downstream of the flow generators 101 and 102.

Preferably, each injection device is configured for generating a pressure drop upstream of the corresponding injection region 1.1 and 1.2, and upstream of the corresponding region of the intermediate region 201 in the case of the flow generator 103, when it injects a gaseous fluid (the effect known as the Venturi effect being achieved).

The machine 100 further comprises a control device for controlling the actuation of the flow generators 101, 102 and 103 (of the injection devices), such that a continuous or a discontinuous and selective injection of gaseous fluid, as required, may be performed.

Figure 5:
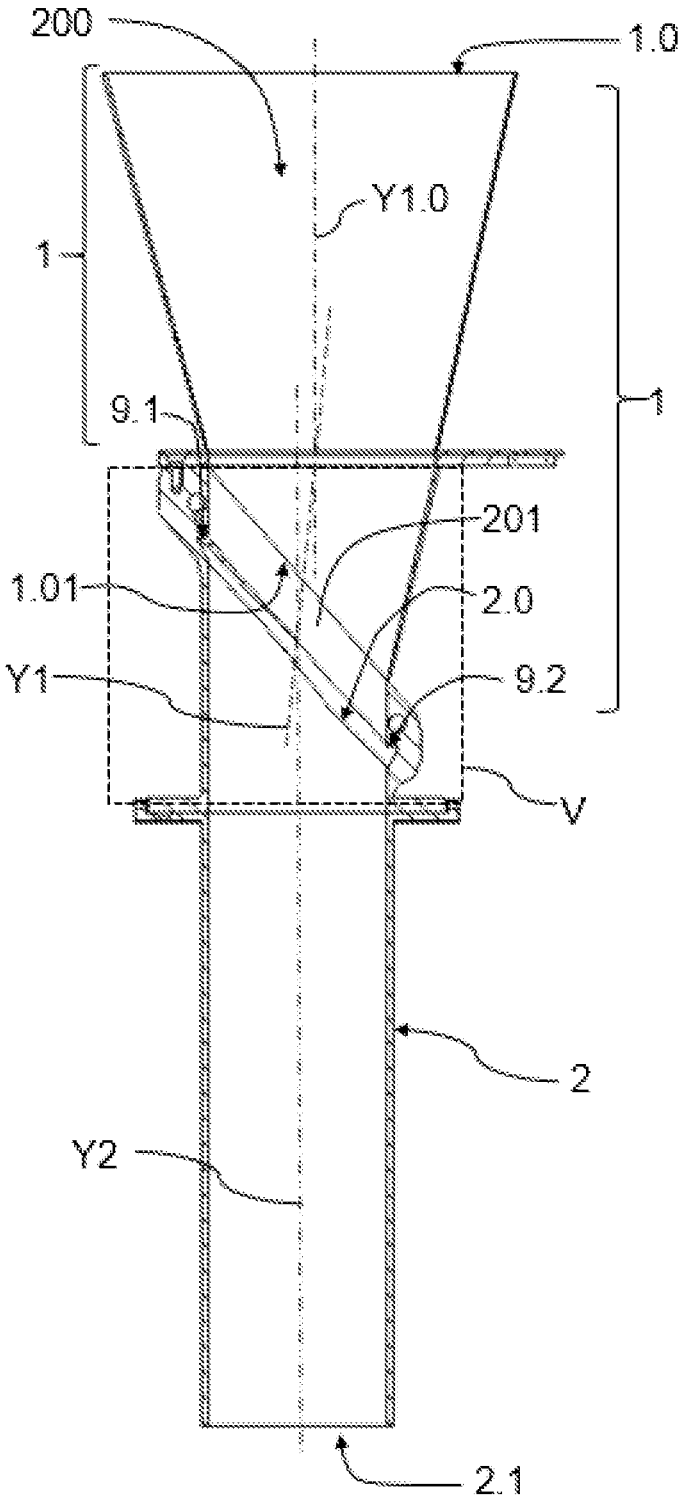
FIG. 5 shows a cut-away view of a supply conduit of a second embodiment of the machine of the invention.
Figure 6:
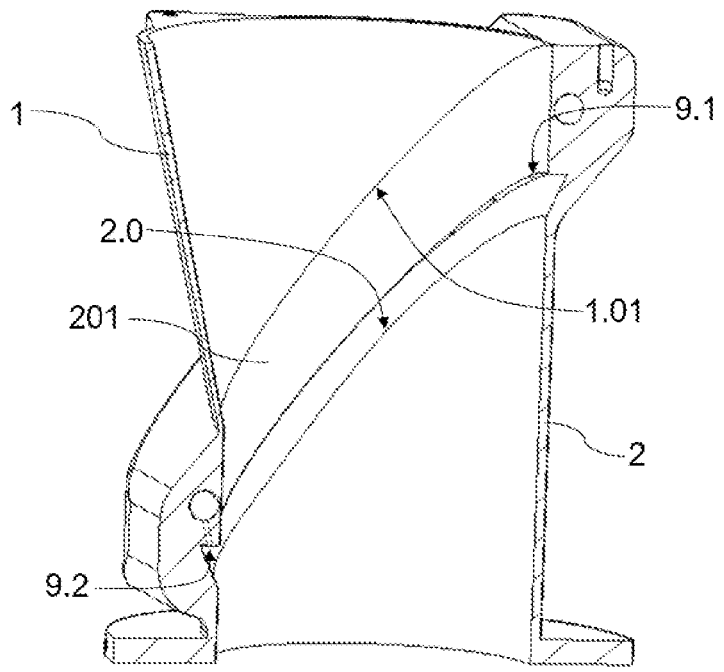
FIG. 6 is a first perspective view of an intermediate region of detail V of FIG. 5.
Figure 7:
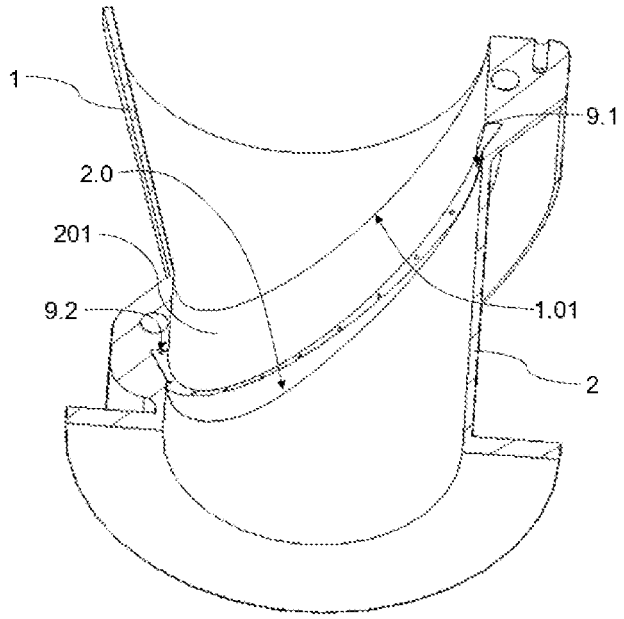
FIG. 7 is a second perspective view of the intermediate region of detail V of FIG. 5.
Figure 8:
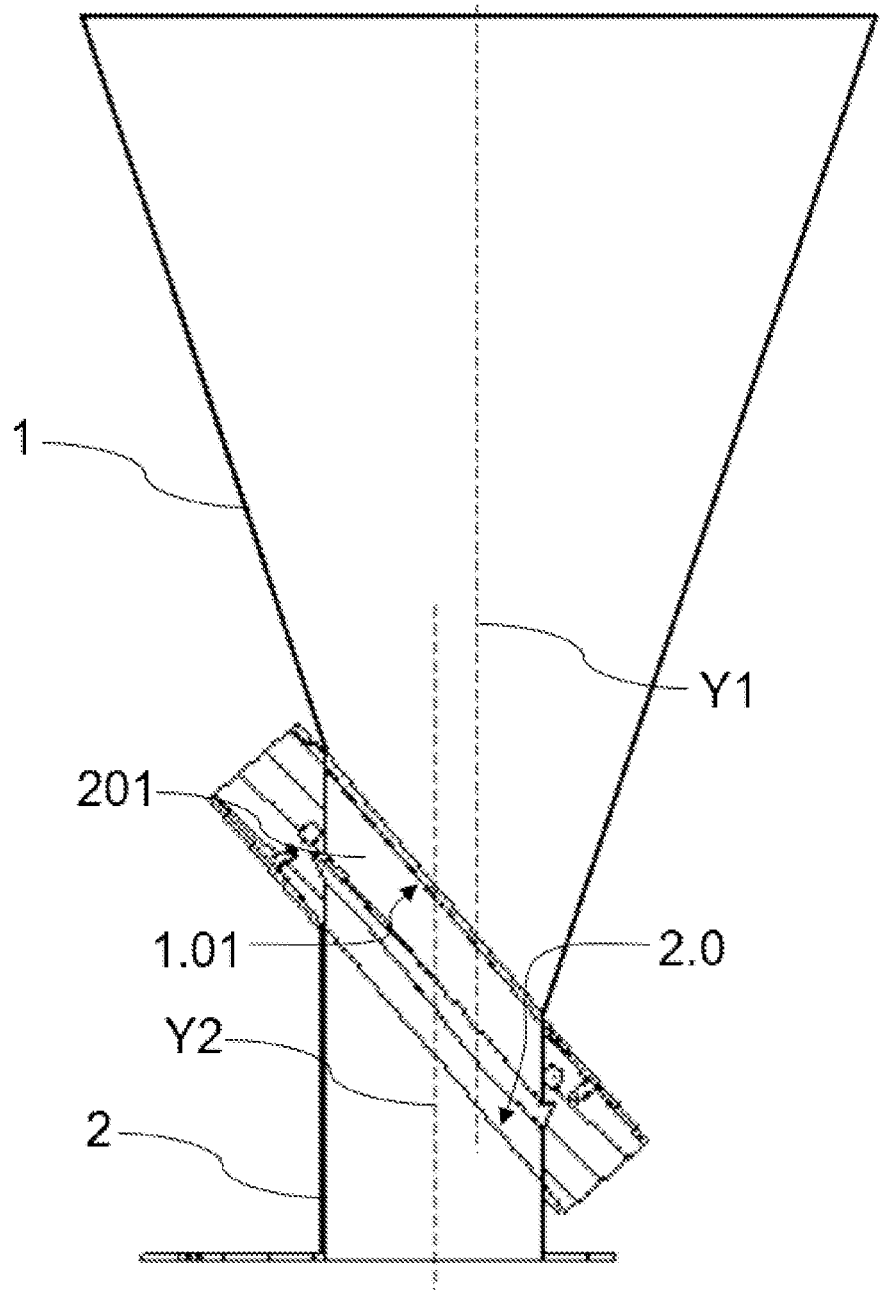
FIG. 8 shows a cut-away view of a supply conduit of a third embodiment of the machine of the invention.

In other embodiments of the machine 100, the hopper 1 that is part of the supply conduit 200 preferably comprises a single hopper outlet mouth 1.01, as depicted in FIGS. 5 to 7 (relative to a second embodiment of the machine 100) and in FIG. 8 (relative to a third embodiment of the machine 100). The acceleration means comprise a flow generator 101 with an injection device configured for injecting a gaseous fluid into the supply conduit 200, in the intermediate region 201 of the supply conduit 200, and through at least the injection ports 9.1 and 9.2. The arrangement and actuation of the injection device is configured for generating a pressure drop upstream of the injection ports 9.1 and 9.2 when it injects a gaseous fluid, with an airstream being produced which pushes the product from the hopper 1 into the tube 2 due to the Venturi effect.

In these embodiments with a single hopper outlet mouth 1.01, the machine 100 preferably comprises a plurality of injection ports in the intermediate region 201 about the hopper axis Y1 with an angular length of 360°, preferably distributed homogeneously.

In these embodiments, the hopper 1 may comprise a hopper axis Y1 with a given angle with respect to the vertical (with respect to the tube axis Y2 of the tube 2), as occurs in the second embodiment (FIGS. 5 to 7), or it may comprise a vertical hopper axis Y1 but not coinciding with the tube axis Y2 of the tube 2, as occurs in the third embodiment (FIG. 8). Therefore, the outlet area delimited by the hopper outlet mouth 1.01 is in a non-horizontal plane (oblique in this case), and the tube inlet mouth 2.1 of the tube 2 delimits an inlet area on an oblique plane also, which may or may not be parallel to the plane of the outlet area which delimits the hopper outlet mouth 1.01. Therefore, in these embodiments, the product also passes progressively through the inlet area delimited by the tube inlet mouth 2.0, said inlet area being larger than in the cases in which said tube inlet mouth 2.0 is horizontal, the risk of jamming being generated in said tube inlet mouth 2.0 being decreased even further and, furthermore, the diameter of the tube 2 can be even further decreased when the product passes progressively and when the product is accelerated at different heights, even further elongating its initial shape.

In some alternative embodiments in which the hopper 1 comprises a single outlet mouth 1.01, the supply conduit 200 comprises a plurality of injection ports in the intermediate region 201, between which there are located the injection ports 9.1 and 9.2, distributed on a distribution plane parallel to the plane of the outlet area delimited by said hopper outlet mouth 1.01 of the hopper 1 and to the plane of the inlet area delimited by the tube inlet mouth 2.1 of the tube 2, said distribution plane being arranged between the plane of the outlet area delimited by the hopper outlet mouth 1.1 of the hopper 1 and the plane of the inlet area delimited by the tube inlet mouth 2.1 of the tube 2, said inlet area and said outlet area being identical.

Preferably, in any of its embodiments the machine 100 has a weighing station upstream of the hopper 1, for example a multi-head weighing station, which feeds a given weight of product (or a given amount of product) to said hopper 1.

What is claimed is:

1. A vertical packaging machine for packaging a product, the vertical packaging machine comprising:

a hopper including a hopper inlet mouth and a hopper outlet mouth located below and downstream the hopper inlet mouth, the hopper outlet mouth delimiting a stepped outlet area or an outlet area in a non-horizontal plane;

a tube located downstream of the hopper and including a tube inlet mouth and a tube outlet mouth located vertically below and downstream of the tube inlet mouth;

a supply conduit through which the product falls, the supply conduit being formed at least in part by the hopper, the tube and an intermediate region extending between the hopper outlet mouth and the tube inlet mouth; and first and second gaseous fluid injection ports that are each located in the intermediate region of the supply conduit and configured to inject the gaseous fluid into the supply conduit in a downward direction, the first gaseous fluid injection port being located at a first height and the second gaseous fluid injection port being located at a second height different than the first height, the first and second gaseous fluid injection ports being configured to cause a pressure drop in the supply conduit above the corresponding first and second gaseous fluid injection ports such that upon the gaseous fluid being injected by the first and second gaseous fluid injection ports, air in the supply conduit follows the injected gaseous fluid to accelerate a falling of the product through the supply conduit.

2. The vertical packaging machine according to claim 1, wherein each of the first and second gaseous fluid injection ports is configured to direct the gaseous fluid into the supply conduit in a downward direction with an inclination of between 0° and 45° with respect to the vertical.

3. The vertical packaging machine according to claim 1, further comprising at least one gaseous fluid flow generator that is fluidly coupled to one or both of the first and second gaseous fluid injection ports.

4. The vertical packaging machine according to claim 1, wherein the hopper outlet mouth comprises a first outlet mouth and a second outlet mouth that are located at different heights between which the stepped outlet area is delimited.

5. The vertical packaging machine according to claim 4, wherein the first gaseous fluid injection port is associated with the first outlet mouth of the hopper and the second gaseous fluid injection port is associated with the second outlet mouth of the hopper, the first gaseous fluid injection port being configured such that upon the gaseous fluid being injected by the first gaseous fluid injection port into the supply conduit, a pressure drop is generated upstream the first outlet mouth of the hopper, the second gaseous fluid injection port being configured such that upon the gaseous fluid being injected by the second gaseous fluid injection port into the supply conduit, a pressure drop is generated upstream the second outlet mouth of the hopper.

6. The vertical packaging machine according to claim 5, wherein the supply conduit includes a first plurality of injection ports including the first injection port associated with the first hopper outlet mouth and a second plurality of injection ports including the second injection port associated with the second hopper outlet mouth.

7. The vertical packaging machine according to claim 1, wherein the hopper outlet mouth comprises first, second and third outlet mouths that are arranged at different heights with respect to one another between which the stepped outlet area is delimited.

8. The vertical packaging machine according to claim 7, wherein the first gaseous fluid injection port is associated with the first outlet mouth of the hopper, the second gaseous fluid injection port is associated with the second outlet mouth of the hopper, and a third gaseous fluid injection port is associated with the third outlet mouth of the hopper, the first gaseous fluid injection port being configured such that upon the gaseous fluid being injected by the first gaseous fluid injection port into the supply conduit, a pressure drop is generated upstream the first outlet mouth of the hopper, the second gaseous fluid injection port being configured such that upon the gaseous fluid being injected by the second gaseous fluid injection port into the supply conduit, a pressure drop is generated upstream the second outlet mouth of the hopper, and the third gaseous fluid injection port being configured such that upon the gaseous fluid being injected by the third gaseous fluid injection port into the supply conduit, a pressure drop is generated upstream the third outlet mouth of the hopper.

9. The vertical packaging machine according to claim 4, wherein the hopper includes a hopper axis and first and second angular segments about the hopper axis, the first angular segment being associated with the first outlet mouth of the hopper, the second angular segment being associated with the second outlet mouth of the hopper.

10. The vertical packaging machine according to claim 9, wherein the first angular segment has a first angular length about the hopper axis and a first vertical length that terminates at the first outlet mouth of the hopper, and the second angular segment has a second angular length about the hopper axis and a second vertical length that terminates at the second outlet mouth of the hopper, the second vertical length being different from the first vertical length.

11. The vertical packaging machine according to claim 10, wherein a cross-section of the first angular segment defines a first angle with respect to the vertical, and a cross-section of the second angular segment defines a second angle with respect to the vertical, the second angle being different than the first angle.

12. The vertical packaging machine according to claim 9, wherein the hopper further comprises an outer casing at least partially externally surrounding the first and second angular segments.

13. The vertical packaging machine according to claim 1, wherein the outlet area delimited by the hopper outlet mouth is on an oblique plane with respect to the vertical, and the tube inlet mouth of the tube delimits an inlet area on an oblique plane with respect to the vertical.

14. The vertical packaging machine according to claim 13, wherein the inlet area delimited by the tube inlet mouth is parallel to the outlet area delimited by the hopper outlet mouth.

15. The vertical packaging machine according to claim 14, wherein, the inlet area and the outlet area are identical.

16. The vertical packaging machine according to claim 13, wherein the first and second gaseous fluid injection ports are distributed on a distribution plane parallel to the oblique plane of the outlet area delimited by the hopper outlet mouth.

17. The vertical packaging machine according to claim 16, wherein the distribution plane is parallel to the oblique plane of the inlet area of the tube inlet mouth, the distribution plane being arranged between the oblique plane of the outlet area delimited by the hopper outlet mouth and the oblique plane of the inlet area delimited by the tube inlet mouth of the tube.

18. The vertical packaging machine according to claim 1, wherein the tube comprises a first central axis and the hopper comprises a second central axis that is horizontally offset from the first central axis.

19. The vertical packaging machine according to claim 18, wherein the first central axis is arranged vertically, and the second central axis is arranged non-vertically.

20. The vertical packaging machine according to claim 1, wherein the first injection port is located horizontally facing an interior of the hopper, the second injection port being located such that the second injection port does not horizontally face the interior of the hopper.

* * * * *